US012465138B2

(12) United States Patent
Ma et al.

(10) Patent No.: US 12,465,138 B2
(45) Date of Patent: Nov. 11, 2025

(54) INCLINED STRUT FOR BENT TUBE BED

(71) Applicant: PINGHU ALLEN FURNITURE CO., LTD, Jiaxing (CN)

(72) Inventors: Xiao Ma, Jiaxing (CN); Yongtao Liu, Shaoyang (CN)

(73) Assignee: PINGHU ALLEN FURNITURE CO., LTD, Jiaxing (CN)

( * ) Notice: Subject to any disclaimer, the term of this patent is extended or adjusted under 35 U.S.C. 154(b) by 543 days.

(21) Appl. No.: 17/944,214

(22) Filed: Sep. 14, 2022

(65) Prior Publication Data

US 2023/0404253 A1 Dec. 21, 2023

(30) Foreign Application Priority Data

Jun. 15, 2022 (CN) ..... 202221493490.X

(51) Int. Cl.
*A47B 3/091* (2006.01)

(52) U.S. Cl.
CPC ..... *A47B 3/0912* (2013.01)

(58) Field of Classification Search
CPC ..... A47B 3/0912; A47C 17/70
See application file for complete search history.

(56) References Cited

U.S. PATENT DOCUMENTS 1,446,924 A * 2/1923 Nicholson ..... A47B 3/0912 403/85
1,557,402 A * 10/1925 Bateson ..... A47B 3/0912 16/346
1,660,723 A * 2/1928 Robineau ..... A47B 3/0912 108/160
1,785,342 A * 12/1930 Gilbert ..... A47B 3/0912 403/100
1,788,102 A * 1/1931 Gilbert ..... A47B 3/0912 403/100
2,485,178 A * 10/1949 Weinkauf ..... A47B 3/0912 182/155
2,665,181 A * 1/1954 Pucci ..... A47B 3/0912 108/131
2,692,176 A * 10/1954 Miller ..... A47B 3/0912 108/155
2,756,082 A * 7/1956 Pucci ..... A47B 3/0912 403/111
3,357,729 A * 12/1967 Krueger ..... A47B 3/0912 108/130
3,709,454 A * 1/1973 Hyde ..... A47D 7/002 248/440

(Continued)

*Primary Examiner* — Hanh V Tran

(57) ABSTRACT

Disclosed is an inclined strut for a bent tube bed, which includes an inclined strut assembly with one end hinged to a bed body and the other end hinged to a bed leg, wherein the inclined strut assembly includes a first brace rod and a second brace rod which are mutually hinged, a locking sleeve is slidably connected to the second brace rod, a limit slot is disposed the locking sleeve towards one end of the first brace rod, and a limit protrusion disposed on the first brace rod is inserted into the limit slot; and the locking sleeve has a side opening, the side opening is internally provided with an elastic protrusion connected to the locking sleeve, and the elastic protrusion abuts against the second brace rod. The inclined strut is novel in structure and convenient to use, and has perfect overall functionality and strong practicability.

5 Claims, 7 Drawing Sheets

(56) References Cited

U.S. PATENT DOCUMENTS

| | | | | | |
|---|---|---|---|---|---|
| 4,270,239 | A * | 6/1981 | Gross | F16B 7/04 | 403/100 |
| 4,574,937 | A * | 3/1986 | Anderson | B65G 21/00 | 198/321 |
| 5,509,361 | A * | 4/1996 | Chen | A47B 3/0912 | 403/231 |
| 5,572,934 | A * | 11/1996 | Aldridge | A47B 37/00 | D6/686 |
| 6,371,034 | B1 * | 4/2002 | Simpson | A47B 3/0912 | 108/129 |
| 6,422,157 | B2 * | 7/2002 | Rumph | A47B 3/0912 | 108/132 |
| 9,895,003 | B2 * | 2/2018 | Choi | A47C 19/04 | |
| 2003/0024445 | A1 * | 2/2003 | Nien | A47B 3/0912 | 108/127 |
| 2005/0006931 | A1 * | 1/2005 | Meskill | A47B 3/0912 | 297/158.4 |
| 2007/0012228 | A1 * | 1/2007 | Tsai | A47B 3/091 | 108/126 |
| 2008/0060563 | A1 * | 3/2008 | Yang | A47B 3/0912 | 108/126 |
| 2009/0078165 | A1 * | 3/2009 | Tseng | E04G 1/32 | 108/6 |
| 2011/0100270 | A1 * | 5/2011 | Atkins | A47B 3/0912 | 108/127 |
| 2015/0305490 | A1 * | 10/2015 | Chang | A47B 13/02 | 108/128 |
| 2017/0196363 | A1 * | 7/2017 | Ray | A47C 17/70 | |
| 2017/0196364 | A1 * | 7/2017 | Choi | A47C 19/025 | |

* cited by examiner

INCLINED STRUT FOR BENT TUBE BED

TECHNICAL FIELD

The present disclosure relates to the technical field of furniture manufacturing, and more particularly, to an inclined strut for a bent tube bed.

BACKGROUND

In order to enable a bent tube bed on the market to be conveniently folded and closed up, inclined struts are disposed between a bed body and bed legs. Most of the inclined struts can realize length adjustment or bending so as to allow the bed legs to be folded and unfolded. However, most of the traditional inclined struts adopt a locking structure with a built-in spring to realize the locking of the inclined struts after adjustment of the lengths thereof or bending of the angles thereof. Although the locking is stable, the structure is complex, the manufacturing cost is high, and the overall effect is poor. Accordingly, the present disclosure provides an inclined strut for a bent tube bed.

SUMMARY

The object of the present disclosure is to overcome the above-mentioned defects of the prior art, and to provide an inclined strut for a bent tube bed, which has the characteristics of being novel in structure and convenient to use.

In order to solve the above technical problems, the object of the present disclosure is achieved in such a way that: the present disclosure relates to an inclined strut for a bent tube bed, which includes an inclined strut assembly with one end hinged to a bed body and the other end hinged to a bed leg, where the inclined strut assembly includes a first brace rod and a second brace rod which are mutually hinged, a locking sleeve is slidably connected to the second brace rod, a limit slot is disposed the locking sleeve towards one end the first brace rod, and a limit protrusion disposed on the first brace rod is inserted into the limit slot.

The present disclosure is further configured as follows: the locking sleeve has a side opening, the side opening is internally provided with an elastic protrusion connected to the locking sleeve, and the elastic protrusion abuts against the second brace rod.

The present disclosure is further configured as follows: the locking sleeve is provided with a locking mark adjacent to the first brace rod, and an unlocking mark far from the first brace rod.

The present disclosure is further configured as follows: a baffle is located at one side of the second brace rod to restrict its unidirectional rotation, and the baffle is disposed on the first brace rod.

The present disclosure is further configured as follows: a notch of the limit slot has a flaring portion.

To sum up, the present disclosure has the following beneficial effects: the inclined strut for the bent tube bed according to the present disclosure can perform the bending operation between the first brace rod and the second brace rod by separating the limit slot from the limit protrusion, and the locking sleeve can slide on the second brace rod, so that the adjustment is convenient and fast; and therefore, the present disclosure is simple in structure, flexible to use and operate, perfect in overall functionality and strong in practicability.

DETAILED DESCRIPTION

In order to make those skilled in the art better understand the technical solutions of the present disclosure, the preferred implementations of the present disclosure are described below in conjunction with specific embodiments, but it should be understood that these descriptions are intended only to further illustrate the characteristics and advantages of the present disclosure and not to limit the claims of the present disclosure. Based on the embodiments of the present disclosure, all other embodiments obtained by those of ordinary skill in the art without creative work shall fall within the protection scope of the present disclosure.

The present disclosure will be further described below with reference to the accompanying drawings and preferred embodiments.

Embodiment 1

Figure 1:
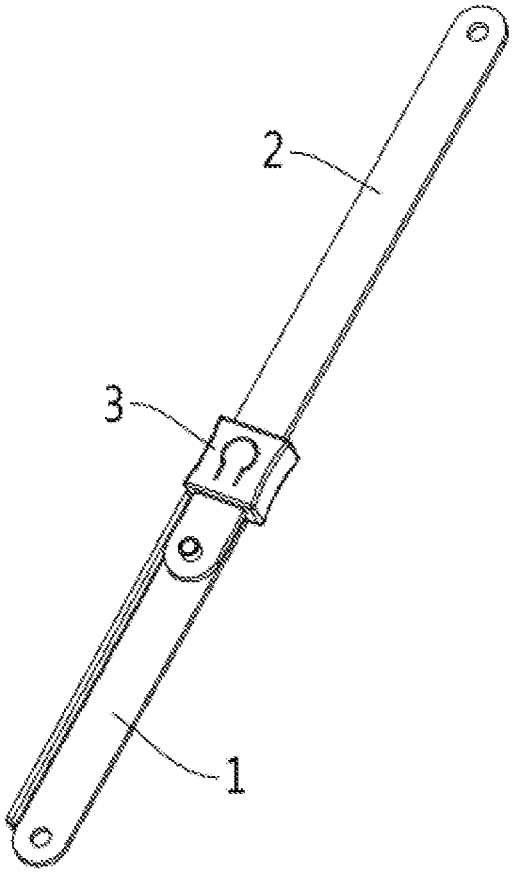
FIG. 1 is a schematic diagram of an overall structure of the present disclosure.
Figure 2:
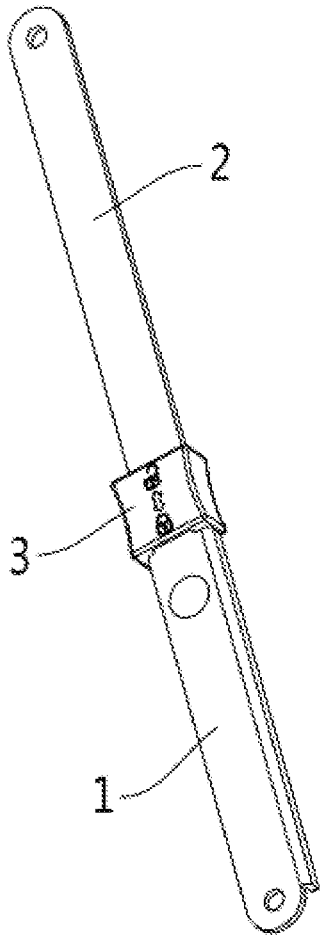
FIG. 2 is a structural schematic diagram of FIG. 1 from another perspective.
Figure 3:
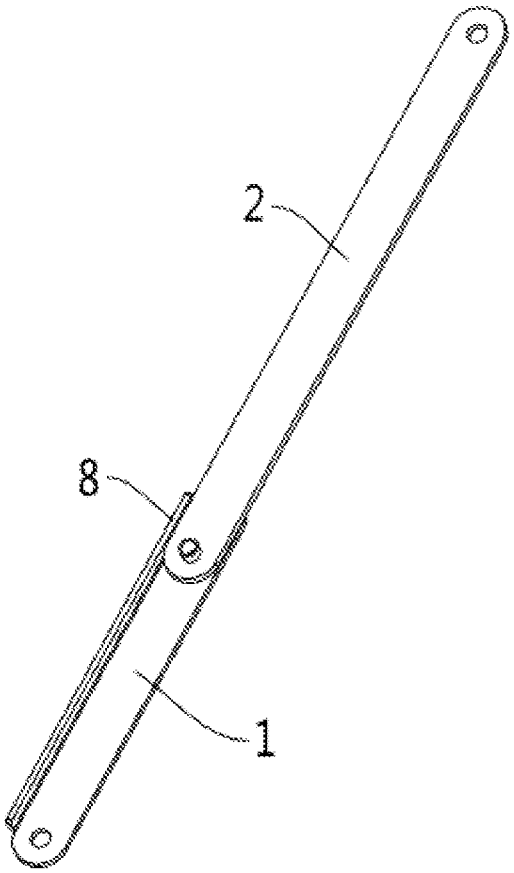
FIG. 3 is a partial structural schematic diagram of the present disclosure.
Figure 4:
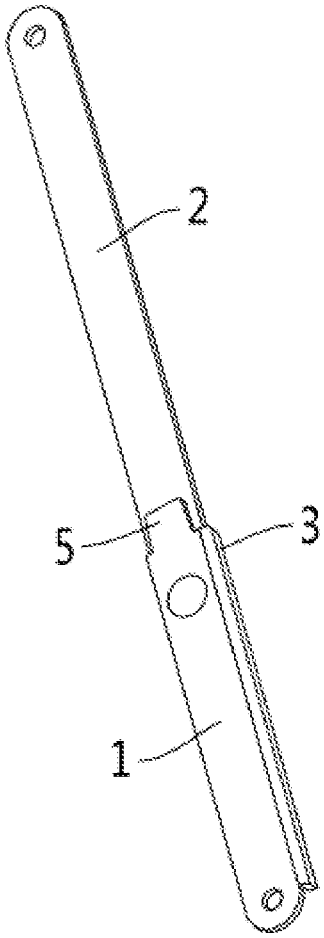
FIG. 4 is a structural schematic diagram of FIG. 3 from another perspective.
Figure 5:
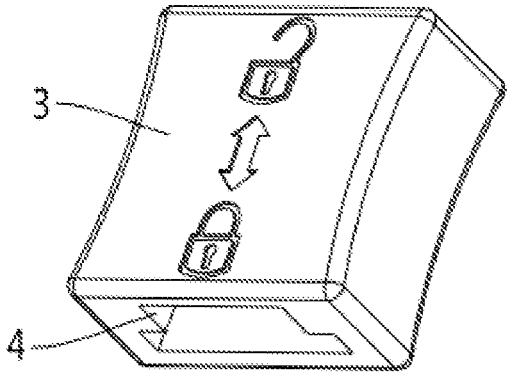
FIG. 5 is a schematic diagram showing an overall structure of a locking sleeve according to the present disclosure.
Figure 6:
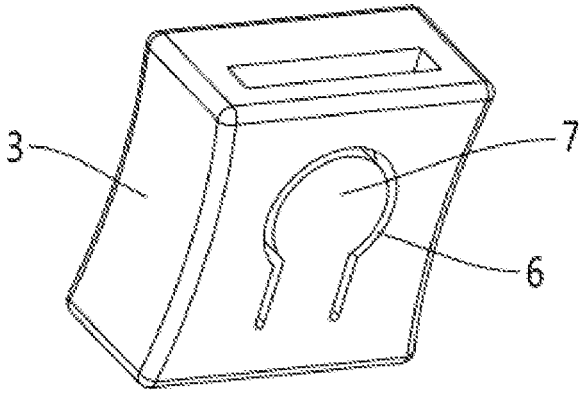
FIG. 6 is a structural schematic diagram of FIG. 5 from another perspective.
Figure 7:
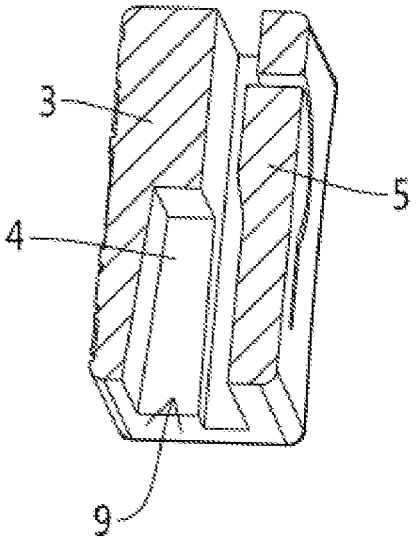
FIG. 7 is a schematic diagram showing an internal structure of the locking sleeve according to the present disclosure.
Figure 8:
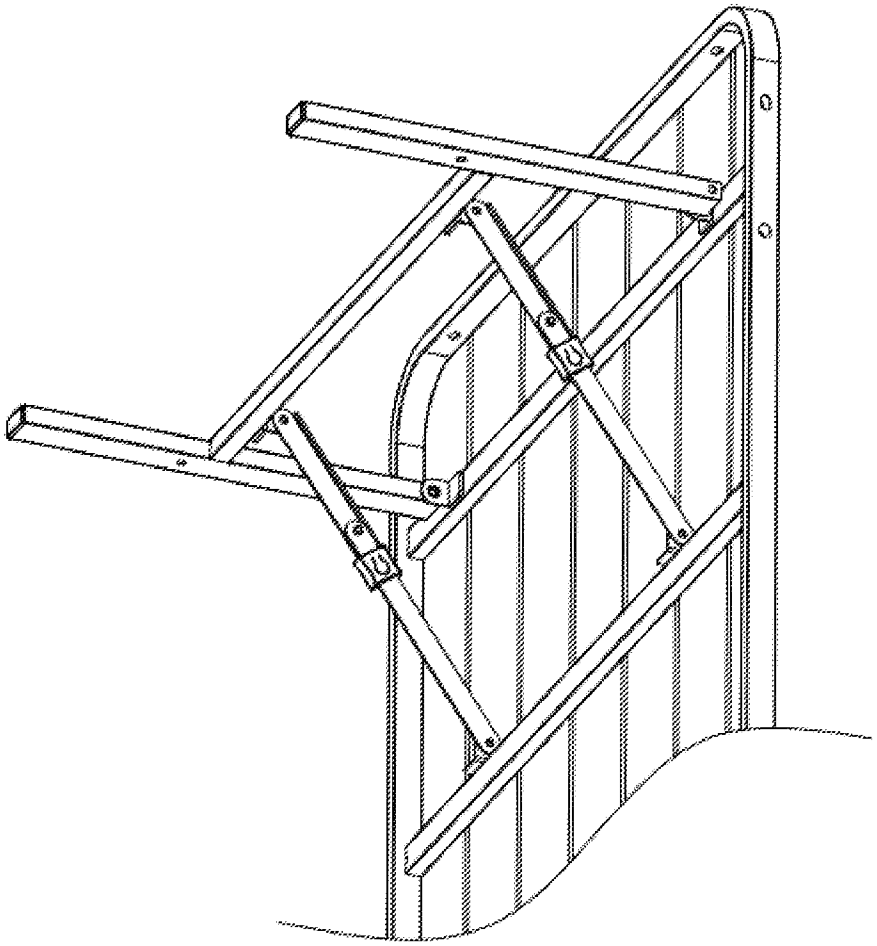
FIG. 8 is a structural schematic diagram of the present disclosure in an installed state.

As shown in FIGS. 1 to 8, an inclined strut for a bent tube bed according to the present embodiment includes an inclined strut assembly with one end hinged to a bed body and the other end hinged to a bed leg, where the inclined strut assembly includes a first brace rod 1 and a second brace rod 2 which are mutually hinged, a locking sleeve 3 is slidably connected to the second brace rod 2, a limit slot 4 is disposed the locking sleeve 3 towards one end the first brace rod 1, and a limit protrusion 5 disposed on the first brace rod 1 is inserted into the limit slot 4.

Further, the locking sleeve 3 has a side opening 6, the side opening 6 is internally provided with an elastic protrusion 7 connected to the locking sleeve 3, and the elastic protrusion 7 abuts against the second brace rod 2.

Further, the locking sleeve 3 is provided with a locking mark adjacent to the first brace rod, and an unlocking mark far from the first brace rod.

Further, a baffle 8 is located at one side of the second brace rod 2 to restrict its unidirectional rotation, and the baffle 8 is disposed on the first brace rod 1.

Further, a notch of the limit slot 4 has a flaring portion 9.

In the present implementation, first, the limit protrusion 5 is in a state of being inserted into the limit slot 4, and the first brace rod 1 cannot rotate relative to the second brace rod 2; and the locking sleeve 3 is manually slid to enable the locking sleeve 3 moves backwards in the direction of the first brace rod 1, thereby realizing the separation between the limit protrusion 5 and the limit slot 4, so that the first brace rod 1 can rotate relative to the second brace rod 2.

The side opening 6 is matched with the elastic protrusion 7, and the elastic protrusion 7 is kept abutted against the second brace rod 2 in a normal state, so that the locking sleeve 3 that has completed sliding can stay on the second brace rod 2 arbitrarily, and random sliding is further avoided.

Due to the arrangement of the locking mark and the unlocking mark, a marking role is played.

The baffle 8 plays a one-way limiting role and also has a rotation positioning function.

Due to the arrangement of the flaring portion 9, the insertion of the limit protrusion 5 into the limit slot 4 is facilitated, and a guiding role is played.

The inclined strut for the bent tube bed according to the present disclosure can perform a bending operation between the first brace rod and the second brace rod by separating the limit slot from the limit protrusion, and the locking sleeve can slide on the second brace rod, so that the adjustment is convenient and fast; and therefore, the present disclosure is simple in structure, flexible to use and operate, perfect in overall functionality and strong in practicability.

Unless otherwise specified, in the present disclosure if the terms 'length', 'width', 'upper', 'lower', 'front', 'rear', 'left', 'right', 'vertical', 'horizontal', 'top', 'bottom', 'inner', 'outer', 'clockwise', 'counterclockwise', 'axial', 'radial', 'circumferential' and other indicated orientations or positional relationships are based on the actually shown orientations or positional relationships, which is only for the convenience of describing the present disclosure and simplifying the description, rather than indicating or implying that the device or element referred to must have a specific orientation, and must be constructed and operated in a specific orientation. Therefore, the terms describing the orientation or positional relationship in the present disclosure are only for illustrative purposes, and cannot be interpreted as a limitation on the present application. For those of ordinary skill in the art, the specific meanings of the above terms can be understood according to specific circumstances in combination with the embodiments.

Unless otherwise specified and defined, in the present disclosure, the terms 'disposed', 'connected to' and 'connected' shall be understood in a broad sense, for example, they can be a fixed connection, a detachable connection, or an integrated connection; and it can be a direct connection or an indirect connection through an intermediate medium, and it can be an internal connection of two elements. For those skilled in the art, the specific meanings of the above terms in the present disclosure can be understood according to specific circumstances.

The preferred embodiments of the present disclosure have been described in detail above. It should be understood that those skilled in the art can make numerous modifications and changes according to the concept of the present disclosure without creative work. Therefore, any technical solutions that can be obtained by those skilled in the art through logical analysis, reasoning or limited experiments on the basis of the prior art according to the concept of the present disclosure shall fall within the protection scope determined by the claims.

What is claimed is:

1. An inclined strut for a bent tube bed, comprising an inclined strut assembly with one end hinged to a bed body and the other end hinged to a bed leg, wherein the inclined strut assembly comprises a first brace rod and a second brace rod which are mutually hinged, a locking sleeve is slidably connected to the second brace rod, a limit slot is disposed in the locking sleeve towards one end of the first brace rod, and a limit protrusion disposed on the first brace rod is inserted into the limit slot, wherein the locking sleeve has a side opening, the side opening is internally provided with an elastic protrusion connected to the locking sleeve, and the elastic protrusion abuts against the second brace rod.

2. The inclined strut for the bent tube bed according to claim 1, wherein the locking sleeve is provided with a locking mark adjacent to the first brace rod, and an unlocking mark far from the first brace rod.

3. The inclined strut for the bent tube bed according to claim 1, a baffle is located at one side of the second brace rod to restrict its unidirectional rotation, and the baffle is disposed on the first brace rod.

4. The inclined strut for the bent tube bed according to claim 2, a baffle is located at one side of the second brace rod to restrict its unidirectional rotation, and the baffle is disposed on the first brace rod.

5. The inclined strut for the bent tube bed according to claim 1, wherein a notch of the limit slot has a flaring portion.

* * * * *